US010638798B2

(12) United States Patent
Glaude et al.

(10) Patent No.: US 10,638,798 B2
(45) Date of Patent: May 5, 2020

(54) ADJUSTABLE FOUNDATION GARMENT

(71) Applicants: Carrie Glaude, Francestown, NH (US); Patricia Hennessy, Dublin, NH (US); Maurice Glaude, Francestown, NH (US); Dana Hennessy, Dublin, NH (US)

(72) Inventors: Carrie Glaude, Francestown, NH (US); Patricia Hennessy, Dublin, NH (US); Maurice Glaude, Francestown, NH (US); Dana Hennessy, Dublin, NH (US)

( * ) Notice: Subject to any disclaimer, the term of this patent is extended or adjusted under 35 U.S.C. 154(b) by 0 days.

(21) Appl. No.: 15/638,686

(22) Filed: Jun. 30, 2017

(65) Prior Publication Data

US 2018/0177245 A1 Jun. 28, 2018

Related U.S. Application Data

(60) Provisional application No. 62/439,808, filed on Dec. 28, 2016.

(51) Int. Cl.

| | |
|---|---|
| ***A41C 1/08*** | (2006.01) |
| ***A41C 1/12*** | (2006.01) |
| ***A41F 9/02*** | (2006.01) |
| ***A41C 1/00*** | (2006.01) |
| ***A41F 9/00*** | (2006.01) |

(52) U.S. Cl.

CPC ..... *A41C 1/08* (2013.01); *A41C 1/12* (2013.01); *A41F 9/025* (2013.01); *A41C 1/003* (2013.01); *A41F 9/007* (2013.01)

(58) Field of Classification Search

CPC ..... A41C 1/08; A41C 1/003; A41F 9/025

See application file for complete search history.

(56) References Cited

U.S. PATENT DOCUMENTS 3,566,879 A * 3/1971 Braun ..... A41C 1/00 450/117
3,678,514 A * 7/1972 Safrit ..... A41B 9/08 2/212
4,325,379 A * 4/1982 Ozbey ..... A41D 13/0017 450/104
4,910,802 A * 3/1990 Malloy ..... A63B 21/4019 2/69
5,201,074 A * 4/1993 Dicker ..... A41D 13/0015 2/227
5,267,928 A * 12/1993 Barile ..... A63B 21/4025 2/228
5,308,305 A * 5/1994 Romney ..... A63B 21/4025 2/69
5,465,428 A * 11/1995 Earl ..... A63B 21/0552 2/227
5,653,467 A * 8/1997 Griffin ..... A63C 11/001 280/809

(Continued)

*Primary Examiner* — Alissa J Tompkins
*Assistant Examiner* — Brieanna Szafran
(74) *Attorney, Agent, or Firm* — Dunlap Bennett & Ludwig PLLC

(57) ABSTRACT

An elastic garment having a waist band and a pair of leg sleeves. A plurality of strips are secured to the pair of leg sleeves and run up the garment so that a top end of the strips extend above the waist band. The top ends of the strips include a hook and loop fastener that attaches to hook and loop fastener patches of the waist band.

12 Claims, 6 Drawing Sheets

(56) References Cited

U.S. PATENT DOCUMENTS

| | | | | |
|---|---|---|---|---|
| 5,778,452 | A * | 7/1998 | Dicker | A41D 13/0015 2/227 |
| 6,047,405 | A * | 4/2000 | Wilkinson | A41D 13/0015 2/115 |
| 6,231,488 | B1 * | 5/2001 | Dicker | A41D 13/0015 2/69 |
| 6,454,628 | B1 * | 9/2002 | Shunichirou | A41C 1/003 128/96.1 |
| 7,908,674 | B2 * | 3/2011 | Jones | A41B 11/125 2/242 |
| 9,498,691 | B2 * | 11/2016 | Antoine | A63B 69/0022 |
| 9,782,026 | B2 * | 10/2017 | Cohan | A47G 9/1045 |
| 2007/0027419 | A1 * | 2/2007 | Drennan | A61F 5/0193 602/19 |
| 2013/0040535 | A1 * | 2/2013 | Lim | A41C 1/08 450/95 |
| 2013/0067628 | A1 * | 3/2013 | Harb | A63B 21/0004 2/69 |
| 2013/0150218 | A1 * | 6/2013 | Mial | A63B 21/0407 482/124 |
| 2014/0179497 | A1 * | 6/2014 | von Hoffmann | A63B 23/0494 482/124 |
| 2016/0113801 | A1 * | 4/2016 | Weissleder | A61F 5/0104 602/19 |

* cited by examiner

ADJUSTABLE FOUNDATION GARMENT

CROSS-REFERENCE TO RELATED APPLICATION

This application claims the benefit of priority of U.S. provisional application No. 62/439,808, filed Dec. 28, 2016, the contents of which are herein incorporated by reference.

BACKGROUND OF THE INVENTION

The present invention relates to a foundation garment and, more particularly, to an adjustable foundation garment.

A foundation garment (also known as a shapeware or a shaping underwear) is an undergarment designed to temporarily alter the wearer's body shape, to achieve a more fashionable figure. The function of a foundation garment is not to enhance a bodily feature (as would, for example, a padded bra) but to smooth or control the display of one.

Foundation garments currently on the market do not allow a user to adjust the garment to reach a desired body shape. Other products, such as tape, adhere to the skin. However, tape may fall off, may be painful to remove and is not reusable.

As can be seen, there is a need for an adjustable foundation garment to shape a user's body.

SUMMARY OF THE INVENTION

In one aspect of the present invention, a garment comprises: a waist band comprising an upper rim; a pair of leg sleeves extending downward from the waist band, each of the pair of leg sleeves comprising a lower rim, wherein the waist band and the pair of leg sleeves are made of an elastic material; a first strip comprising a bottom end and a top end, wherein the bottom end is attached to one of the pair of leg sleeves and runs upwards, and the top end extends above the waist band and comprises a hook and loop fastener; a second strip comprising a bottom end and a top end, wherein the bottom end is attached to the other of the pair of leg sleeves and runs upwards, and the top end extends above the waist band and comprises a hook and loop fastener; a first hook and loop fastener patch attached to an outer surface of the waist band below the top end of the first strip and releasably attachable to the hook and loop fastener of the first strip; and a second hook and loop fastener patch attached to an outer surface of the waist band below the top end of the second strip and releasably attachable to the hook and loop fastener of the second strip.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Figure 1:
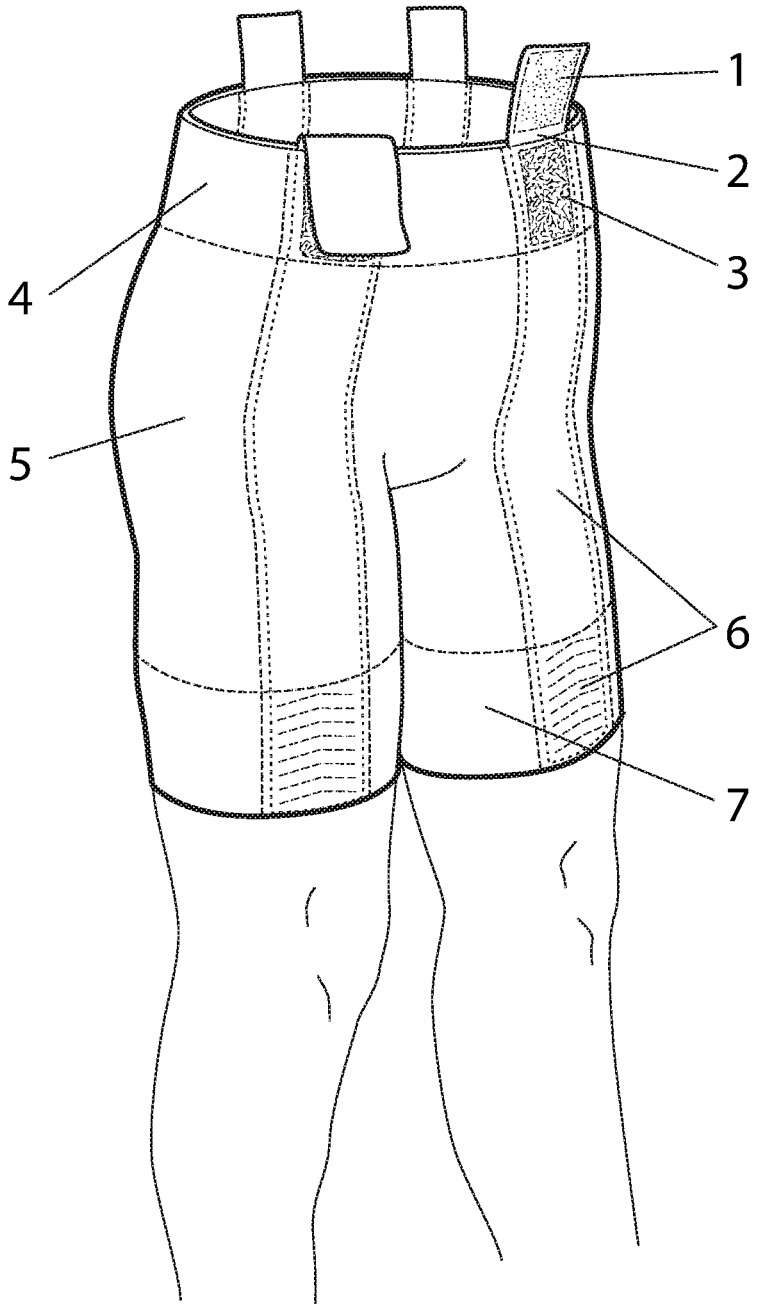
FIG. 1 is a front perspective view of an embodiment of the present invention.

Referring to FIG. 1, the present invention includes a garment, such as pants or shorts. The garment includes a waist band 4 having an upper rim and a pair of leg sleeves 5 extending downward from the waist band 4. The pair of leg sleeves 5 are tubular sleeves sized to fit around legs of a user. The garment further includes a front portion to cover a crotch of a user and a rear portion to cover a buttocks of a user. The garment is made of an elastic material, such as woven elastane fibers so that the garment is skin tight.

The present invention may further include a plurality of strips 6. Each of the strips 6 include a bottom end and a top end. The bottom end of a first strip 6 is attached to one of the pair of leg sleeves 5 and the bottom end of a second strip 6 is attached to the other of the pair of leg sleeves 5. The strips 6 run upwards along the pair of leg sleeves 5 and the top ends of each of the strips 6 extend above the waist band 4. The top ends of the strips 6 each include a hook and loop fastener 1. Hook and loop fastener patches 3 may be attached to an outer surface of the waist band 4 below each of the top ends of the strips 6. The hook and loop fastener patches 3 releasably attach to the hook and loop fasteners 1 of the strips 6.

The present invention may include four strips 6. The first and second strips 6 may be disposed on the front side of the garment and a third and fourth strips 6 may be disposed on the back side of the garment. The bottom end of the third strip 6 is attached to one of the pair of leg sleeves 5 and the bottom end of the fourth strip 6 is attached to the other of the pair of leg sleeves 5.

The strips 6 of the present invention may be made of the elastic material of the garment, such as woven elastane fibers. In certain embodiments, the strips 6 may be stitched to an inner surface of the leg sleeves 5 all the way up to the waist band 4. The waist band 4 may be a reinforced with an additional layer of material, such as the woven elastane fibers. Pockets 2 may be formed in between the additional layer of material and the waist band 4. The top ends of the strips 6 may protrude through the pockets 2.

The garment may further include gripping layers 7. The gripping layers 7 may be secured to an inner surface of a bottom portion of the pair of leg sleeves 5. The gripping layers 7 may be disposed circumferentially about the inner surface. The gripping layers 7 may be made of a rubberized material, such as silicone, rubber and the like.

In use, the user may place the garment over their legs and pull the garment up to their waist. To adjust the garment, the user may detach the top ends of the straps 6 from the hook and loop fastener patches 3 on the waist band 4. The user may then pull upward on the straps 6. The gripping layers 7 may grip the skin of the legs, pulling upwards on the skin into a taught position. The user may then reconnect the top ends of the straps 6 to the hook and loop fastener patches 3, retaining the taught position.

Figure 2:
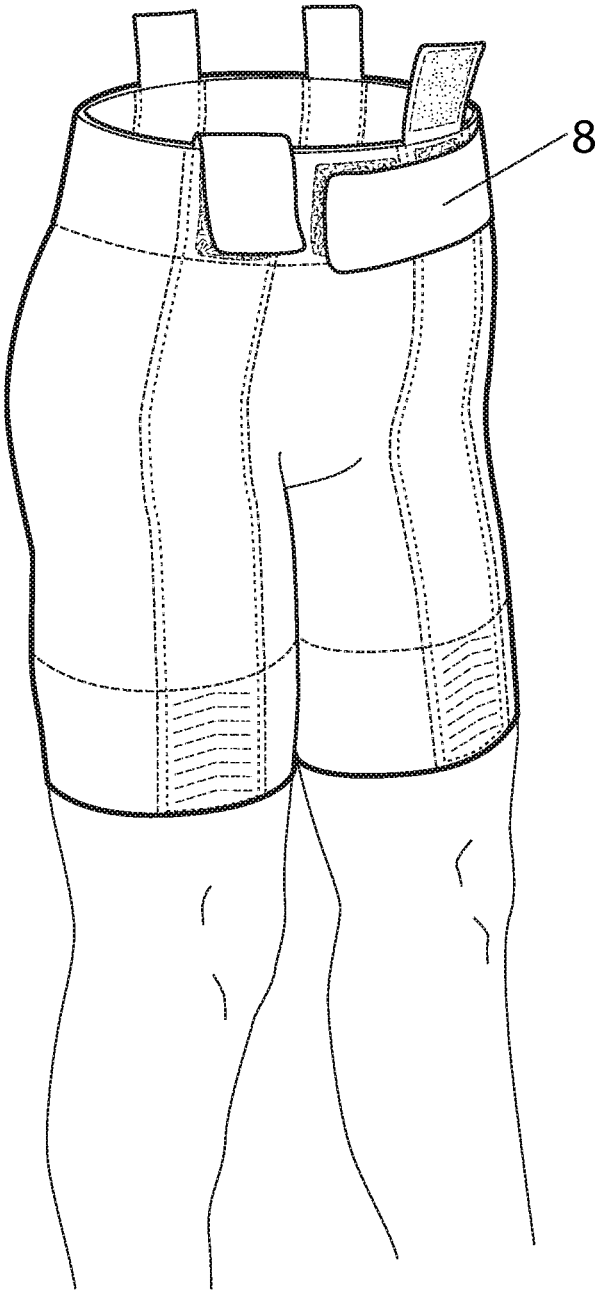
FIG. 2 is a front perspective view of an embodiment of the present invention.

Referring to FIG. 2, a size of the waist band may be adjustable. The present invention may include a waist strap 8 having a first end attached to the waist band and a second end having a hook and loop fastener. In such embodiments, the waist band includes a hook and loop fastener patch releasably attachable to the hook and loop fastener of the waist strap. The user may thereby pull the waist strap 8 and attach the waist strap 8 to the waist band in order to adjust the size of the waist band.

Figure 3:
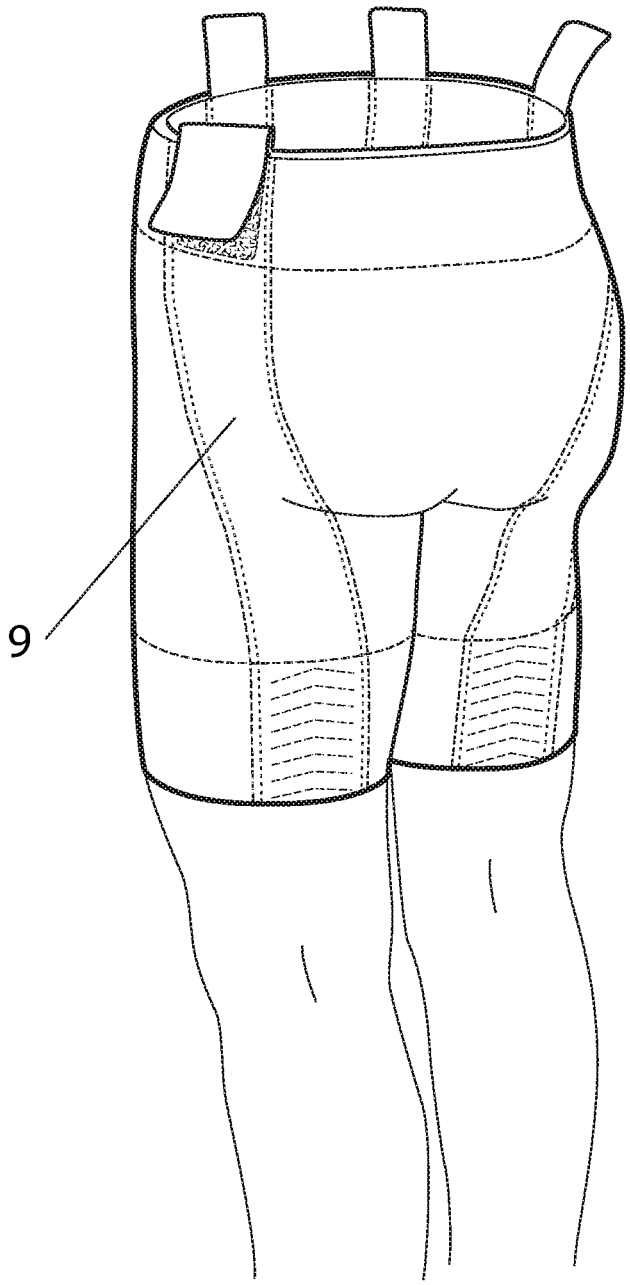
FIG. 3 is a rear perspective view of an embodiment of the present invention.
Figure 4:
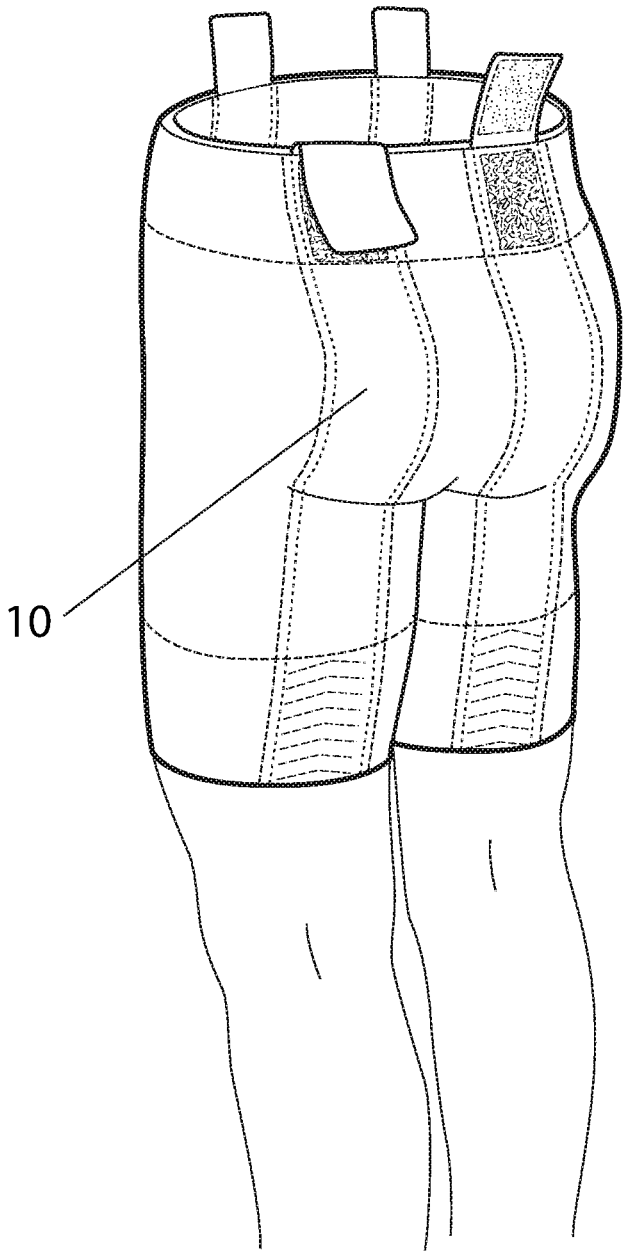
FIG. 4 is a rear perspective view of an embodiment of the present invention.

Referring to FIG. 3, the garment of the present invention may include a third strip 9 and a fourth strip 9 that are positioned to cover a portion of a user's thighs and buttocks. Referring to FIG. 4, the garment of the present invention may include a third strip 10 and a fourth strip 10 that are positioned to cover a user's buttocks only. The different positioning of the straps 9, 10 lift different areas of the user's body.

Figure 5:
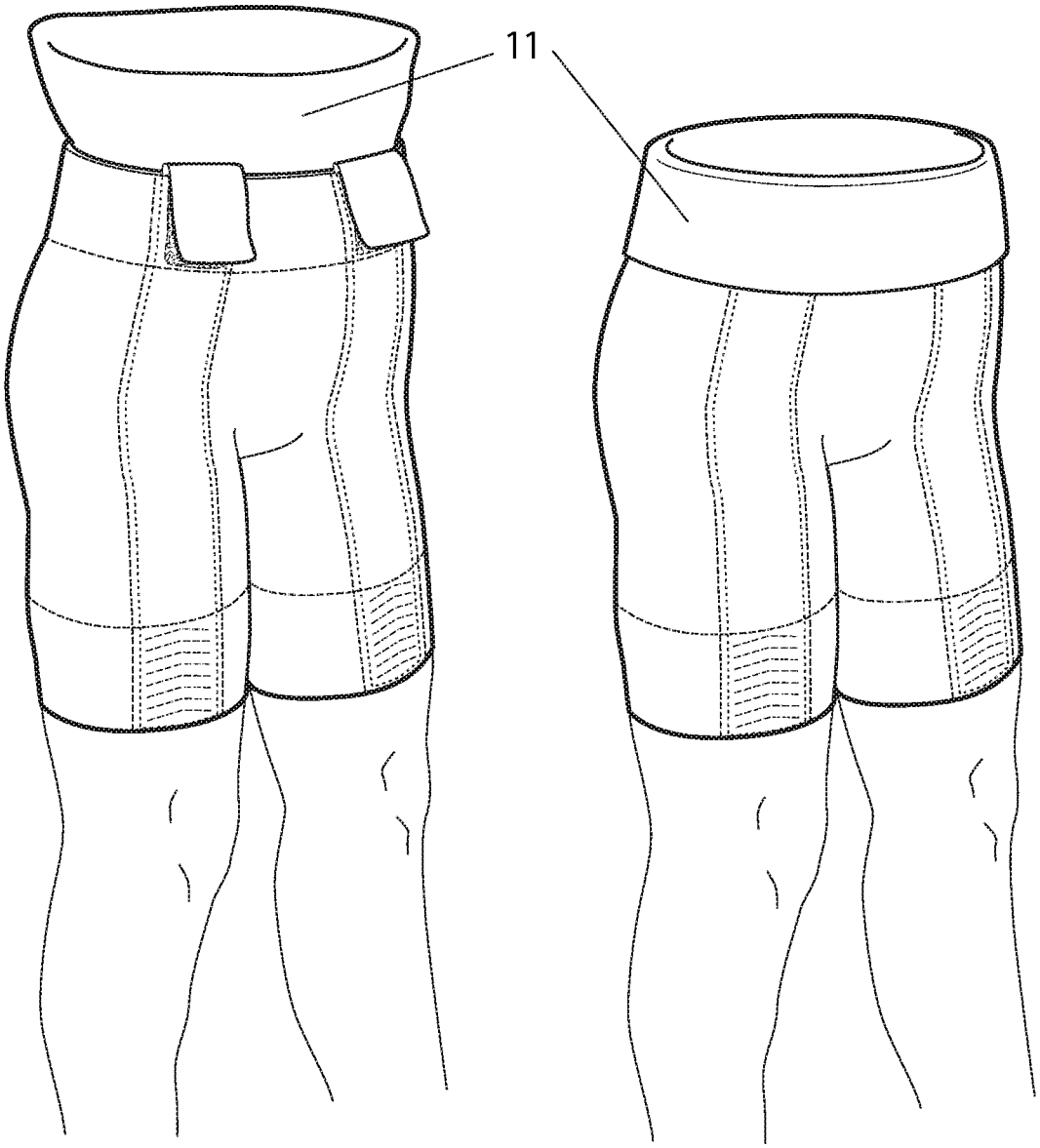
FIG. 5 is a front perspective view of an embodiment of the present invention illustrating a fold over waist band cover.
Figure 6:
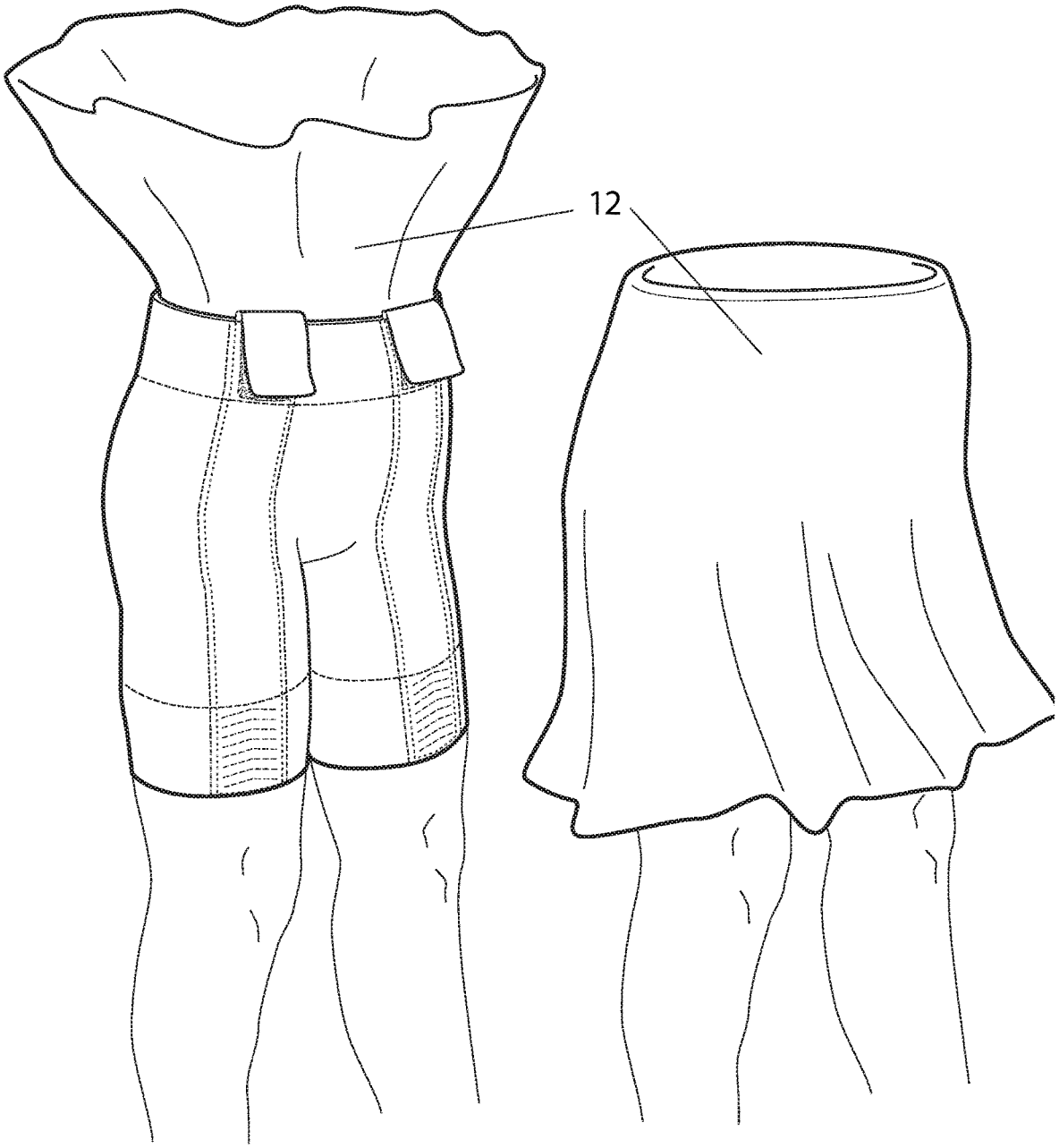
FIG. 6 is a front perspective view of an embodiment of the present invention illustrating a fold over skirt.

Referring to FIG. 5, the garment of the present invention may include a waist band cover 11 stitched to an inner surface of the waist band. The waist band cover 11 extends beyond the upper rim and folds over to cover the outer surface of the waist band. Referring to FIG. 6 the waist band cover may be a skirt 12 that is stitched to the inner surface of the waist band, folds over the waist band and extends below the lower rim of the pair of leg sleeves.

It should be understood, of course, that the foregoing relates to exemplary embodiments of the invention and that modifications may be made without departing from the spirit and scope of the invention as set forth in the following claims.

What is claimed is:

1. A garment comprising:

a waist band comprising a lower rim, an upper rim opposite the lower rim, an outer surface, and an inner surface opposite the outer surface;

a pair of leg sleeves extending downward from the waist band, each of the pair of leg sleeves comprising a lower rim, wherein the waist band and the pair of leg sleeves are made of an elastic material;

a first strip comprising a bottom end and a top end, wherein the bottom end is attached to one of the pair of leg sleeves and runs upwards, and the top end extends above the upper rim of the waist band and comprises a hook and loop fastener;

a second strip comprising a bottom end and a top end, wherein the bottom end is attached to the other of the pair of leg sleeves and runs upwards, and the top end extends above the upper rim of the waist band and comprises a hook and loop fastener;

a first hook and loop fastener patch attached to the outer surface of the waist band below the top end of the first strip, wherein the top end of the first strip folds downward and the hook and loop fastener of the first strip attaches to the first hook and loop fastener patch; and a second hook and loop fastener patch attached to the outer surface of the waist band below the top end of the second strip, wherein the top end of the second strip folds downward and the hook and loop fastener of the second strip attaches to the second hook and loop fastener patch.

2. The garment of claim 1, further comprising:

a third strip comprising a bottom end and a top end, wherein the bottom end is attached to one of the pair of leg sleeves and runs upwards, and the top end extends above the upper rim of the waist band and comprises a hook and loop fastener;

a fourth strip comprising a bottom end and a top end, wherein the bottom end is attached to the other of the pair of leg sleeves and runs upwards, and the top end extends above the upper rim of the waist band and comprises a hook and loop fastener;

a third hook and loop fastener patch attached to the outer surface of the waist band below the top end of the third strip and is releasably attached to the hook and loop fastener of the third strip; and a fourth hook and loop fastener patch attached to the outer surface of the waist band below the top end of the fourth strip and is releasably attached to the hook and loop fastener of the fourth strip.

3. The garment of claim 2, wherein the third strip and the fourth strip are positioned to cover a portion of a user's thighs and buttocks.

4. The garment of claim 2, wherein the third strip and the fourth strip are positioned to cover a user's buttocks.

5. The garment of claim 1, further comprising a gripping layer secured to an inner surface of each of the pair of leg sleeves adjacent to the bottom rim.

6. The garment of claim 5, wherein the gripping layer is disposed circumferentially about the inner surface.

7. The garment of claim 5, wherein the gripping layer is silicone.

8. The garment of claim 1, wherein the waist band, the pair of leg sleeves, the first strip and the second strip are made of elastane fibers.

9. The garment of claim 1, wherein a size of the waist band is adjustable and comprises a waist strap comprising a first end attached to the waist band and a second end comprising a hook and loop fastener, wherein the waist band comprises a hook and loop fastener patch releasably attachable to the hook and loop fastener of the waist strap.

10. The garment of claim 1, further comprising a waist band cover stitched to the inner surface of the waist band, wherein the waist band cover extends beyond the upper rim and folds over to cover the outer surface of the waist band.

11. The garment of claim 1, wherein the waist band cover is a skirt that extends below the lower rim of the pair of leg sleeves.

12. The garment of claim 1, wherein the waist band a reinforced with an additional layer of material, wherein pockets are formed in between the additional layer of material and the elastic material, wherein the first and second strips protrude through the pockets.

* * * * *